US006346767B1

(12) United States Patent
Swadel et al.

(10) Patent No.: US 6,346,767 B1
(45) Date of Patent: Feb. 12, 2002

(54) LAMP WITH FORMED, CEMENTED CLIP TO SECURE BASE TO LAMP

(75) Inventors: Joseph C. Swadel, Rockingham; Howard D. Taggart, Gilford, both of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/456,755

(22) Filed: Dec. 8, 1999

(51) Int. Cl.[7] ..... H01J 5/48; H01J 5/50; H01K 1/00

(52) U.S. Cl. ..... 313/318.01; 313/318.1; 313/318.08; 313/318.69; 439/611; 439/615; 439/235

(58) Field of Search ..... 313/51, 993, 634, 313/318.01, 318.03, 318.09, 318.1; 362/61, 226, 374; 439/611, 615, 235; 24/563, 67.9; 411/198, 202, 203, 211, 221, 316, 317, 322

(56) References Cited

U.S. PATENT DOCUMENTS 5,289,079 A * 2/1994 Wittmann ..... 439/611 X
5,381,070 A * 1/1995 Tuttle et al. ..... 439/615 X
5,521,460 A * 5/1996 Zhu ..... 313/318.09 X
5,603,627 A * 2/1997 Evanisko ..... 439/235
5,751,105 A * 5/1998 Csertag et al. ..... 313/493

* cited by examiner

*Primary Examiner*—Vip Patel
*Assistant Examiner*—Mack Haynes
(74) *Attorney, Agent, or Firm*—William H. McNeill

(57) ABSTRACT

A lamp has an electrically insulating, light-transmitting, preferably lead-free envelope with a base end and contains a light source. At least two electrical lead-ins are connected to the light source and exit the envelope. A base is affixed to the base end, the base having first and second electrically conductive portions separated by an electrically insulating portion. One of the electrical lead-ins is electrically connected to the first electrically conductive portion and another of the electrically conductive lead-ins is electrically connected to the second electrically conductive portion. The base is non-rotationally mounted to the base end of the lamp by a locking clip affixed to the first electrically conductive portion by mechanical means and affixed to the base by chemical means.

9 Claims, 2 Drawing Sheets

LAMP WITH FORMED, CEMENTED CLIP TO SECURE BASE TO LAMP

TECHNICAL FIELD

This invention relates electric lamps and more particularly to such lamps having non-rotatable bases.

BACKGROUND ART

There are several known techniques for securing a screw base onto a lamp outer jacket. The latter generally takes the form of a glass bulb. One conventional method is to mold a threaded area on the lower or base portion of the outer jacket glass so that a screw base can be threaded thereon. During the formation of the threads an indentation also is made near the top thereof. When the lamp is being completed, one of the in-lead wires of the lamp is pressed into a lead solder slug and the lead solder slug is inserted into the indentation. The base is threaded onto the lamp over the lead solder slug, heat is applied, and the solder joint is completed. This operation electrically connects one of the lamp in-leads to the base and mechanically holds the base onto the glass bulb of the outer jacket. A significant problem with this basing technique is that the lead solder can pose an environmental problem when the lamp is disposed of, as well as creating a manufacturing hazard during the production of the lamp.

Recently, other techniques have been proposed to alleviate the hazards in the use of the lead solder. Among these techniques are those shown in U.S. Pat. Nos. 5,381,070 and 5,521,460 (these two patents being assigned to the assignee of the instant invention) and 5,550,422. While all of these approaches solved the problem of lead solder usage, they introduced other concerns.

For example, the solution represented by U.S. Pat. No. 5,550,422 has the undesirable requirement that the base clip must be physically attached to the lamp by snapping it onto the bottom seal of the lamp. This provides an additional step in the manufacturing process. Further, the clip is attached to an area of the glass that is normally more fragile. The area at the bottom can have sharper angles and residual stress that make the area susceptible to glass fracture. By attaching the clip to this area, glass fractures can occur both during lamp manufacture or when the lamp is being extracted from a tight socket.

The methods shown in U.S. Pat. Nos. 5,381,070 and 5,521,460 avoid these problems by making the mechanical and electrical connection through a clip that is not attached to the bottom seal of the lamp. However, a disadvantage of these two designs is that the clip has sharp edges. These sharp edges are in contact with the glass in the area where the base is mechanically secured to the lamp. When a torque is applied to the base, for example, during extraction from a socket, the sharp edges impinge on the glass and place a high-localized pressure on the glass. This pressure can achieve levels that are sufficient to fracture the glass. This is an undesired potential failure mode because the lamp jacket can separate from the base, leaving a base with sharp glass fragments in the socket. It is also possible that such a failure mode will expose the lamp electrical circuit, thus creating the risk of an electrical shock.

Another issue occurring with the designs of U.S. Pat. Nos. 5,381,070 and 5,521,460 is that they can create an outward protrusion that extends outwardly past the base shell by more than 0.050 inches, a distance that exceeds ANSI specifications. The outward extension of the clips of these patents has a straight portion that is normally bent over the base shell during the basing operation, typically forming a radius at the clip-to-shell interface. This radius, also, can often be too large and form a protrusion that is beyond the ANSI specification.

A solution to the above-cited problems is shown in U.S. application Ser. No.: 09/357,027, still pending filed Jul. 20, 1999, and assigned to the assignee of the present invention. Therein, a locking clip is provided for fixing a base to an end of a glass bulb. The locking clip comprises a body having a first portion, a middle portion and an end portion, with the middle portion being scyphate and defining a plane. The first portion extends away from the plane in a given direction by an angle of about 5 degrees. The end portion is connected to the middle portion by a reentrant section and extends away from the plane in a direction opposite the given direction by an angle of about 20 degrees. The scyphate middle portion extends the full width of the clip and thus provides only softly curving surfaces in contact with a groove in the glass. This design works extremely well with leaded Nonex glass, eliminating the lead solder slug and controlling the outward extension within ANSI limits. However, when applied to the newest lamp designs, which utilize lead-free glass to eliminate problems associated with the manufacture and disposal of lead containing glass, it has been discovered that the base-clip attachment was not adequate, since the lamps could not pass a routine torque testing without cracking the envelope.

DISCLOSURE OF INVENTION

It is, therefore, an object of this invention to obviate the disadvantages of the prior art.

It is another object of the invention to enhance the base-to-clip junction of lamps.

Yet another object of the invention is the provision of base-to-clip junction that reduces stresses in the lamp.

Still another object of the invention is a lead-free lamp that will not fracture easily during removal from a tight socket.

These objects are accomplished, in one aspect of the invention, by a lamp that comprises an electrically insulating, light-transmitting, lead-free envelope having a base end and containing a light source. At least two electrical lead-ins are connected to the light source and exit the envelope. A base is affixed to the base end, the base comprising first and second electrically conductive portions separated by an electrically insulating portion. One of the electrical lead-ins is electrically connected to the first electrically conductive portion and another of the electrically conductive lead-ins is electrically connected to the second electrically conductive portion. The base is non-rotationally mounted to the base end by a locking clip affixed to the first electrically conductive portion by mechanical means and affixed to the base by chemical means.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
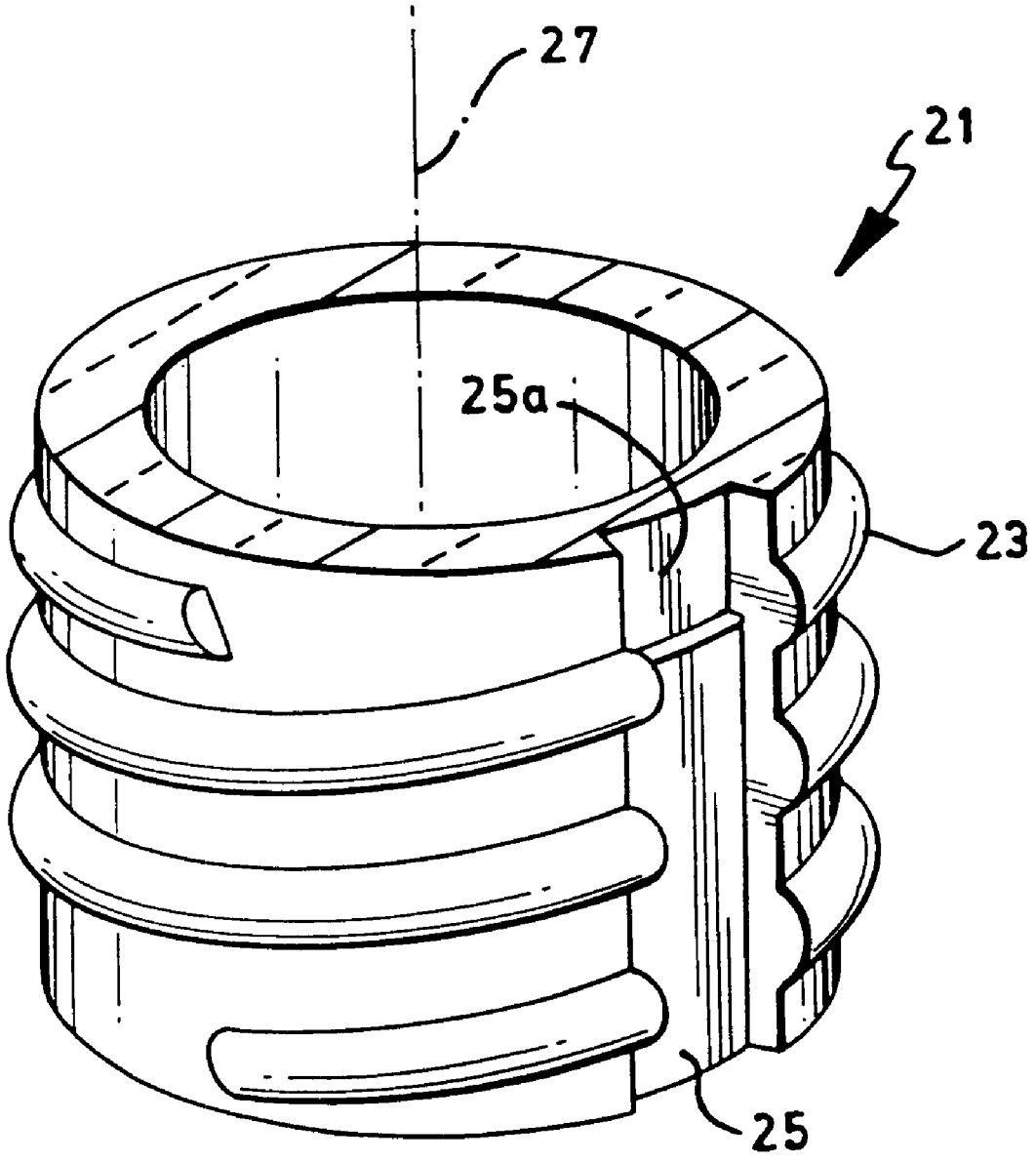
FIG. 1 is a partial, perspective view of a lamp base end.

Referring now to the drawings with greater particularity, there is shown in FIG. 1 the bottom 21 of a glass bulb or envelope 30. Bottom 21 is provided with threads 23 and a lead-in wire receiving groove 25. The upper part of groove 25 is provided with a receiving port 25*a* for accepting the scyphate middle portion 16 of clip 10 (see FIG. 2). The clip 10 can be the locking clip shown and described in detail in the afore-mentioned U.S. application Ser. No. 09/357,027, still pending, the teachings of which are hereby incorporated by reference. The bottom 21 is arranged about a longitudinal axis 27.

Figure 2:
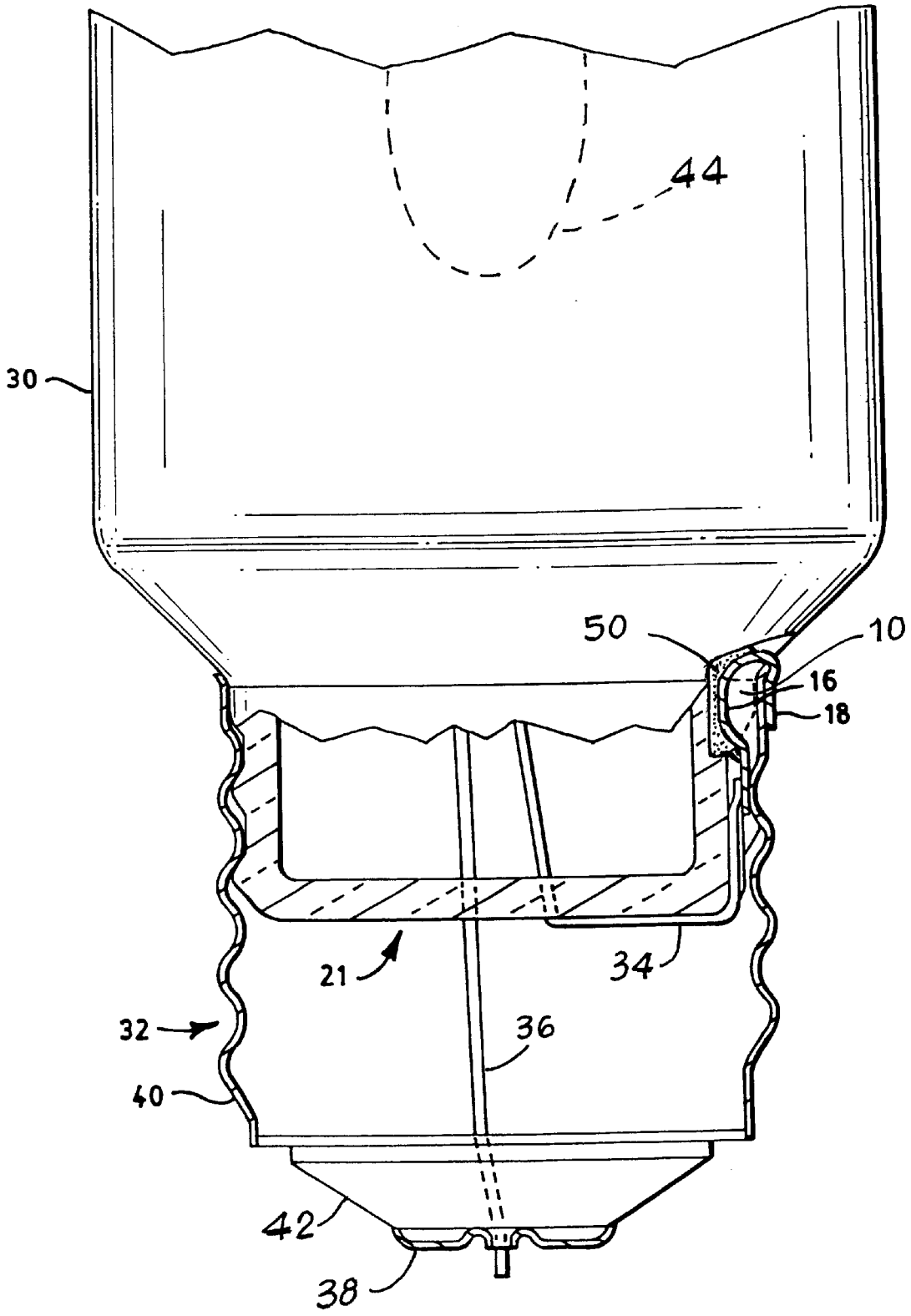
FIG. 2 is an elevational view, partially in section, of the bottom of a lamp with a clip and screw base installed.

Referring now particularly to FIG. 2, a lamp base 32, comprised of a first and second electrically conductive portions 40 and 38, which are separated by an insulating portion 42, is threaded onto bottom 21 after a locking clip 10 has been attached, as by welding, to a lead-in wire 34, and locking clip 10 has had the middle portion 16 inserted into receiving port 25*a*. The other lead-in wire 36 is attached to the central conductor 38 of base 32.

The lead-in wires 34 and 36 extend into the bulb 30 and are electrically connected to a light source 44, which can be an incandescent filament or an arc tube or other light emitting source.

After base 32 is threaded onto bottom 21, end portion 18 of locking clip 10 is welded to the base 32. The welding operation bends the end portion 18 into contact with the base 32 and thus assumes the position shown in FIG. 2, lying parallel to the base and assuring compliance with ANSI specifications concerning protrusion distances.

Thus, locking clip 10 is mechanically connected to the shell 40. Prior to the final assembly of base 32 to lamp end 21 a chemical attachment means 50 is located in receiving port 25*a* to chemically affix the locking clip 10 to the lamp end 21. Chemical attachment means 50 is an adhesive comprised of a filler and silicone resin. In a preferred embodiment of the invention, the filler comprises calcium carbonate and talc. In a still further embodiment, the adhesive comprises a filler containing about 57.8 wgt. % calcium carbonate, about 16.4 wgt. % talc, and about 25.8 wgt. % silicone resin.

It is believed that the reason this system works is because the locking clip no longer touches the glass and the adhesive provides a uniform load distribution. The adhesive cement acts as a buffer that is strong enough not to crush during torque testing, which applies a torque value of 85 in.-lbs., which the lamp must pass. Further, the torque testing is applied after the lamps have passed several other testing procedures, such as a rapid cycle test, an oven test, a humidity test, a salt fog test and a cold box test. The tests subject the lamps to extreme conditions and only then are the lamps subjected to the torque tests.

In addition to these tests, however, modern lamps must also contend with the Federal regulations known as Toxicity Characteristics Leaching Procedures (TCLP). It is the latter that have driven the industry to remove lead from the lamps. It has further been found that for lamps employing the preferred adhesive to pass the TCLP tests, the 1 gram have been shown to be in danger of failing the TCLP tests. It is believed that the reason for this potential failure is because the cement can react with the brass base of the shell during the testing and then the brass is no longer available to react with the mercury in the lamp. (If the light source is an arc discharge unit, it could contain mercury). Under normal disposal conditions, the mercury reacts with the brass base and, as a result, the mercury does not leach out into the solution. The TCLP limit for mercury is to maintain an average of 0.20 mg/liter or less. Lamps that are constructed as shown herein and maintained with an adhesive amount below 1 gram all pass the TCLP tests.

While there have been shown and described what are at present considered the preferred embodiments of the invention, it will be apparent to those skilled in the art that various changes and modifications can be made herein without departing from the scope of the invention as defined by the appended claims.

What is claimed is:

1. A lamp comprising:

an electrically insulating, light-transmitting envelope having a base end and containing a light source;

at least two electrical lead-ins connected to said light source and exiting said envelope;

and a base affixed to said base end, said base comprising first and second electrically conductive portions separated by an electrically insulating portion, one of said electrical lead-ins being electrically connected to said first electrically conductive portion and another of said electrically conductive lead-ins being electrically connected to said second electrically conductive portion, said base being non-rotationally mounted to said base end by a locking clip affixed to said first electrically conductive portion by mechanical means and affixed to said base end by chemical means, said mechanical means comprising welding.

2. The lamp of claim 1 wherein said base end is formed to provide a receptacle for said locking clip.

3. The lamp of claim 2 wherein said receptacle comprises a groove.

4. The lamp of claim 3 wherein said lamp has a longitudinal axis and said groove is parallel thereto.

5. The lamp of claim 1 wherein said chemical means comprises an adhesive.

6. The lamp of claim 5 wherein said adhesive comprises a filler and silicone resin.

7. The lamp of claim 6 wherein said filler comprises calcium carbonate and talc.

8. The lamp of claim 5 wherein said adhesive comprises a filler containing about 57.8 wgt. % calcium carbonate, about 16.4 wgt. % talc and about 25.8 wgt % silicone resin.

9. A lamp comprising:

an electrically insulating, light-transmitting envelope having a base end and containing a light source;

at least two electrical lead-ins connected to said light source and exiting said envelope;

and a base affixed to said base end, said base comprising first and second electrically conductive portions separated by an electrically insulating portion, one of said electrical lead-ins being electrically connected to said first electrically conductive portion and another of said electrically conductive lead-ins being electrically connected to said second electrically conductive portion, said base being non-rotationally mounted to said base end by a locking clip affixed to said first electrically conductive portion by mechanical means and affixed to said base end by chemical means, said locking clip comprising a body having a given width and further having a first portion, a middle portion and an end portion, said middle portion being scyphate and defining a plane and extending the full given width of said clip.

* * * * *